US006786167B2

(12) United States Patent
Ishigaki

(10) Patent No.: US 6,786,167 B2
(45) Date of Patent: Sep. 7, 2004

(54) PROPULSION SYSTEM FOR BOATS

(75) Inventor: Eiichi Ishigaki, Kagawa (JP)

(73) Assignee: Ishigaki Company Limited, Tokyo (JP)

( * ) Notice: Subject to any disclaimer, the term of this patent is extended or adjusted under 35 U.S.C. 154(b) by 0 days.

(21) Appl. No.: 10/148,195

(22) PCT Filed: Oct. 4, 2001

(86) PCT No.: PCT/JP01/08758

§ 371 (c)(1),
(2), (4) Date: Jun. 7, 2002

(87) PCT Pub. No.: WO02/28705

PCT Pub. Date: Apr. 11, 2002

(65) Prior Publication Data

US 2003/0056704 A1 Mar. 27, 2003

(51) Int. Cl.[7] ..... B63H 25/46
(52) U.S. Cl. ..... 114/151
(58) Field of Search ..... 114/151; 440/38, 440/47

(56) References Cited

U.S. PATENT DOCUMENTS

| | | | | | |
|---|---|---|---|---|---|
| 3,590,766 | A | * | 7/1971 | Jackson | 114/151 |
| 4,169,423 | A | * | 10/1979 | Laskey | 114/248 |
| 4,652,244 | A | | 3/1987 | Drury | |
| 5,618,213 | A | | 4/1997 | Nanami | |
| 6,027,383 | A | * | 2/2000 | Broinowski | 440/38 |
| 6,142,841 | A | | 11/2000 | Alexander, Jr. et al. | |
| 6,273,768 | B1 | | 8/2001 | Blanchard | |

FOREIGN PATENT DOCUMENTS

| | | | | |
|---|---|---|---|---|
| FR | 414497 | * | 9/1910 | 440/38 |
| FR | 500683 | | 3/1920 | |
| GB | 1764 | * | 2/1887 | 440/38 |
| GB | 240 | * | 3/1899 | 440/38 |
| JP | 5 5-127295 | | 10/1980 | |
| JP | 5 7-138497 | | 8/1982 | |
| JP | 2-96400 | | 8/1990 | |
| JP | 4-8694 | | 1/1992 | |
| JP | 4-133894 | | 5/1992 | |
| JP | 5-155381 | | 6/1993 | |
| JP | 5-330486 | | 12/1993 | |
| JP | 6-107280 | | 4/1994 | |
| JP | 6-61695 | | 8/1994 | |
| JP | 6-219389 | | 8/1994 | |
| JP | 8-40374 | | 2/1996 | |
| JP | 200 0-168684 | | 6/2000 | |

OTHER PUBLICATIONS

English Language Abstract of JP 6–107280.
English Language Abstract of JP 6–219389.
English Language Abstract of JP 4–8694.
English Language Abstract of JP 8–40374.
English Language Abstract of JP 5–155381.
English Language Abstract of JP 2000–168684.
English Language Abstract of JP 57–138497.
English Language Abstract of JP 5–330486.
English Language Abstract of JP 55–127295.

* cited by examiner

*Primary Examiner*—E. Swinehart
(74) *Attorney, Agent, or Firm*—Greenblum & Bernstein P.L.C.

(57) ABSTRACT

A propelling machine (2) is configured curved- tubular, on a ship bottom (1b), with a front casing (12) having a suction inlet (11) opening fore to water, an impeller casing (10) having an impeller (17) inscribed thereto, and a rear casing (14) having a delivery outlet (13) opening aft to water, and the impeller (17) is forward and reverse rotatable.

11 Claims, 8 Drawing Sheets

Y
Pr4
XIC
1
1a
1b
1c
60
61
62
62a
62b
63
64
65
66
67
68
69
71
72
73
74
75
76
80
81

PROPULSION SYSTEM FOR BOATS

TECHNICAL FIELD

This invention relates to a propulsion system for boats such as a boat to run a shallow, for example, a carrier or a houseboat, or a craft equipped with an auxiliary propulsion system, for example a yacht.

BACKGROUND ART

Japanese Patent Application Laying-Open Publication No. Hei-6-219389 has disclosed a propulsion system for a wind-powered sailing boat that employs, upon entry into or departure from a port or when in a calm, an auxiliary propulsion system having a propeller projecting from the bottom of the boat. Japanese Patent Application Laying-Open Publication No. Hei-6-107280 has disclosed a boat propulsion system of a counter-rotating double-propeller type in which swirling streams generated by a fore propeller are rectified into straight streams by an aft propeller.

Propulsion systems for boats to be propelled by a propeller and steered with a helm to change the direction of course like above are allowed to be relatively simple in arrangement for acquisition of a propelling force to be great, and adapted for transportation of heavy materials, subject to the provision of a shaft projecting from the bottom of boat in the water for mounting the propeller, which has the following problems:

(1) The propeller may bite sands or rock in a shallow, or have string-like drifting matters bound thereon, with a damage to the propeller or the shaft.

(2) In the case of a yacht, the propeller shaft may act as a fluid resistance to the water, constituting a hindrance to the travel speed. A drive for the propeller may have noisy rotation sounds, as it has a clutch disengaged when sailing.

(3) The boat needs to be brought onto the shore for repair or replacement of the propeller.

To this point, Japanese Utility Model Application Laying-Open publication No. Hei-6-61695 has disclosed a propulsion system for boats, which has a swirling vortical casing incorporated in a hull, with a suction inlet and a delivery outlet confronting the bottom, and in which water is drawn by suction at from the suction inlet, to an impeller installed thereabove, where it is pressurized and converted into swirling streams, which are discharged as jets from the delivery outlet to produce a propelling force, while the vortical casing is rotatable about a vertical axis to change the direction of course, with advantageous adaptation for travel such as on a shallow.

Propulsion systems for boats with arrangement like above are adapted, without projections from the bottom, for travel on a shallow, and with provision of the vortical casing turnable to effect backward and transverse travels, for approach to and departure from a pier, subject to the following problems:

(4) Pressurized swirling streams fill the casing, to be discharged as jets, needing a conversion from kinetic energy of the impeller to energy for pressurizing streams to be swirled and a conversion from the pressurizing energy to kinetic energy of jets to be discharged, with losses of energy decreasing efficiency.

(5) The area effective for horizontal jet discharge is kept from being increased in comparison with the casing size, with a low propulsion efficiency in the horizontal direction.

(6) Upon switch between forward and backward travels, an entirety of the casing integrated with the delivery outlet is turned to change the direction, which is heavy, and needs the system to be full-scaled.

DISCLOSURE OF THE INVENTION

This invention has been made with the above-noted problems in view, and it is an object to be solved by the invention, to provide a propulsion system for boats with an incorporated impeller capable of switch between forward and backward travels without turning an impeller casing.

According to an aspect of the invention, in a propulsion system for boats, a propelling machine is configured curved-tubular, on a bottom of boat, with a front casing having a suction inlet opening fore to water, an impeller casing having an impeller inscribed thereto, and a rear casing having a delivery outlet opening aft to water, and the impeller inscribed to the impeller casing is forward and reverse rotatable, whereby water drawn by suction from the front casing and pressurized water to be discharged as jets from the rear casing are changeable in water stream directions inside the propelling machine, as the impeller is rotated forward or reverse, allowing for the boat to have a switched travel direction between forward travel and backward travel, with a great propelling force obtainable by discharging jets of pressurized water into the water.

The impeller inscribed to the impeller casing may preferably be configured as a counter-rotating double impeller comprising a front impeller and a rear impeller, whereby a greater propelling force than by a single impeller is obtainable with an improved suction performance due to water streams in travel and an improved delivery performance due to counter rotation of double impellers.

The impeller inscribed to the impeller casing may preferably comprise axial flow blades, whereby extended blade surfaces can exert increased pressurizing forces on water in forward and reverse rotations.

In particular, as the counter-rotating double impeller has axial flow blades, swirling streams of water pressurized at the front impeller can be guided onto blade surfaces of the rear casing, with increased push-in pressures, to be converted into straight streams by the rear impeller, where they are additionally pressurized.

The impeller casing and the front casing and the rear casing connected to front and rear ends of the impeller casing may preferably have flow paths thereof substantially identical in size of inside diameter, whereby discharge power of pressurized water can be substantially equalized between forward rotation and reverse rotation, allowing for the boat to have a propelling force of forward travel, even in backward travel.

The impeller casing may preferably be configured arcuate, and a drive shaft with the impeller fixed thereon may preferably be supported by bearings disposed on front and rear peripheral walls of the impeller casing, whereby the drive shaft with the impeller fixed thereon can be evenly supported, with reduced vibrations.

The impeller casing may preferably be configured cylindrical, and a drive shaft with axial flow blades fixed thereon may preferably be supported by a bearing support connected to a rear end of the impeller casing and a bearing on a side wall of the front casing, whereby vibrations can be reduced, allowing the propelling machine to be compact, as well.

The suction inlet of the front casing and the delivery outlet of the rear casing may preferably have plural rectification vanes, respectively, whereby water streams drawn by suction are guided into the front casing, and swirling water streams are rectified to be discharged, with an improved propelling performance, while preventing foreign matters from in flowing. If rectification vanes of the front casing are blocked with foreign matters, the impeller can be reverse rotated to wash off the foreign matters blocking the rectification vanes.

The front casing may preferably have a suction flow path inclined fore, and the rear casing may preferably have a delivery flow path inclined aft, whereby suction of water streams in travel as well as aft discharge of jets into the water can be performed with an increased propelling force, allowing an application to a large-scale boat such as a carrier or yacht.

The front casing and the rear casing of the propelling machine may preferably be connected or fastened at lower ends thereof to fixing flanges, and the fixing flanges may preferably be detachably attached to openings of the bottom of boat, whereby the structure can be compact without projections at the bottom of boat, with possible noise reduction. The propelling machine can be configured as a unit attachable to and detachable from the boat bottom.

The impeller casing may preferably be separable fore and aft, whereby the impeller casing with the inscribed impeller can be assembled or disassembled with ease, facilitating the cleaning inside the impeller casing, as well as removal of rope or string-like matters binding on the impeller.

The impeller casing may preferably be separable into an upper half of impeller casing and a rear half of impeller casing, and the drive shaft may preferably be supported by the upper half of impeller casing, whereby the upper half of impeller casing supporting the shaft of the impeller can be removed from the propelling machine, facilitating maintenance services such as repairing.

An inspection hole may preferably be provided to the impeller casing in a vicinity of the impeller, whereby the impeller casing can be internally inspected with ease, with possible prevention of damages that otherwise might occur to the impeller or the like.

A boat-side fronting branch path may preferably be branched from the rear casing, to be cooperative with the rear casing to effect a flow path selection therebetween, whereby transverse propulsion can be achieved.

BRIEF DESCRIPTION OF THE DRAWINGS

FIG. 11A to FIG. 11D show a propulsion system for boats according to another embodiment of the invention, in which FIG. 11A is a plan of the propulsion system, FIG. 11B is a side view of the propulsion system, FIG. 11C is a section of arrow-indicated portion XIC of FIG. 11B, and FIG. 11D illustrates a flow path selection mechanism of the propulsion system.

PREFERRED EMBODIMENTS OF THE INVENTION

Figure 1:
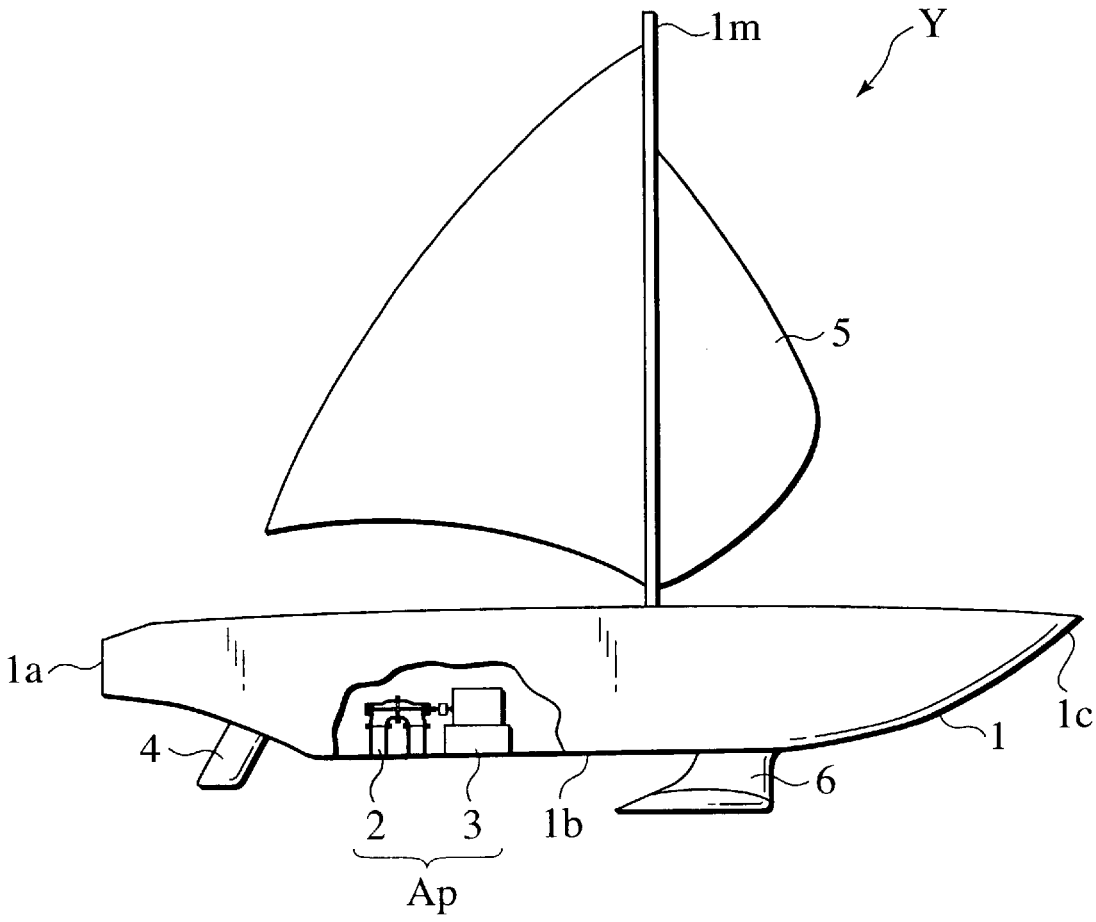
FIG. 1 is an elevation of a yacht equipped with a propulsion system according to an embodiment of the invention.

There will be detailed below preferred embodiments of the invention, with reference to the accompanying drawings. Like members or elements are designated by like reference characters.

Figure 2:
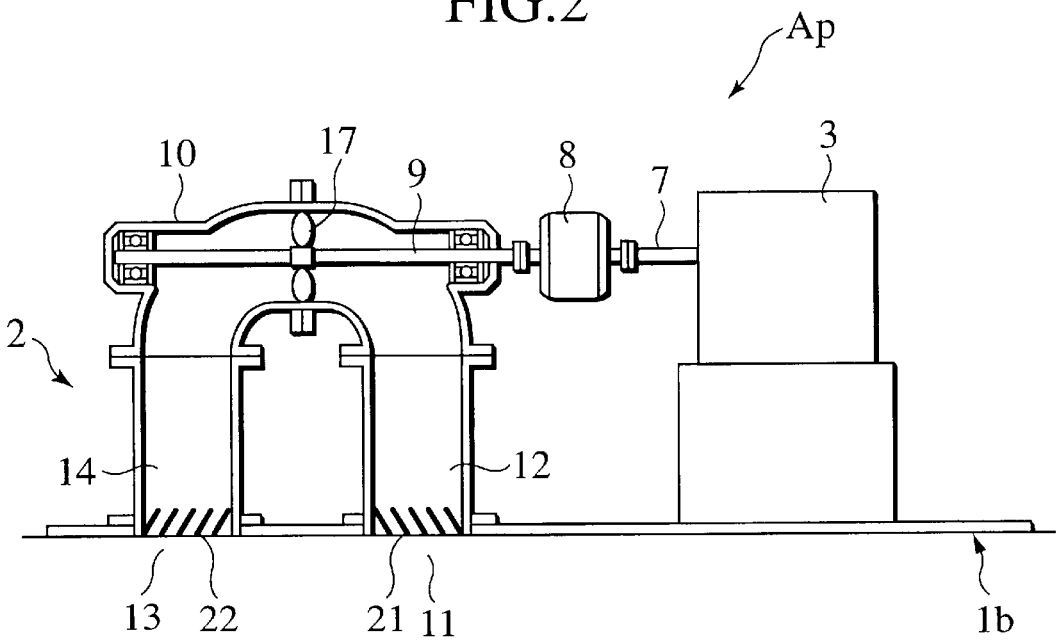
FIG. 2 is a partially longitudinally cutaway side view of the propulsion system of FIG. 1.
Figure 3:
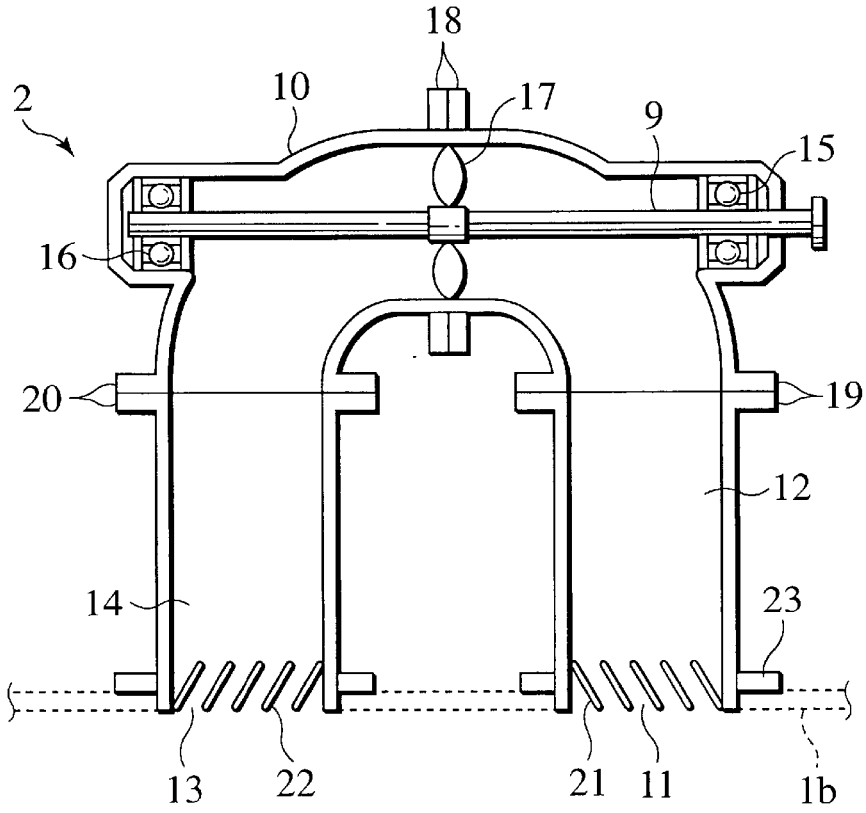
FIG. 3 is a longitudinal sectional view of a propelling machine of the propulsion system of FIG. 2.
Figure 4:
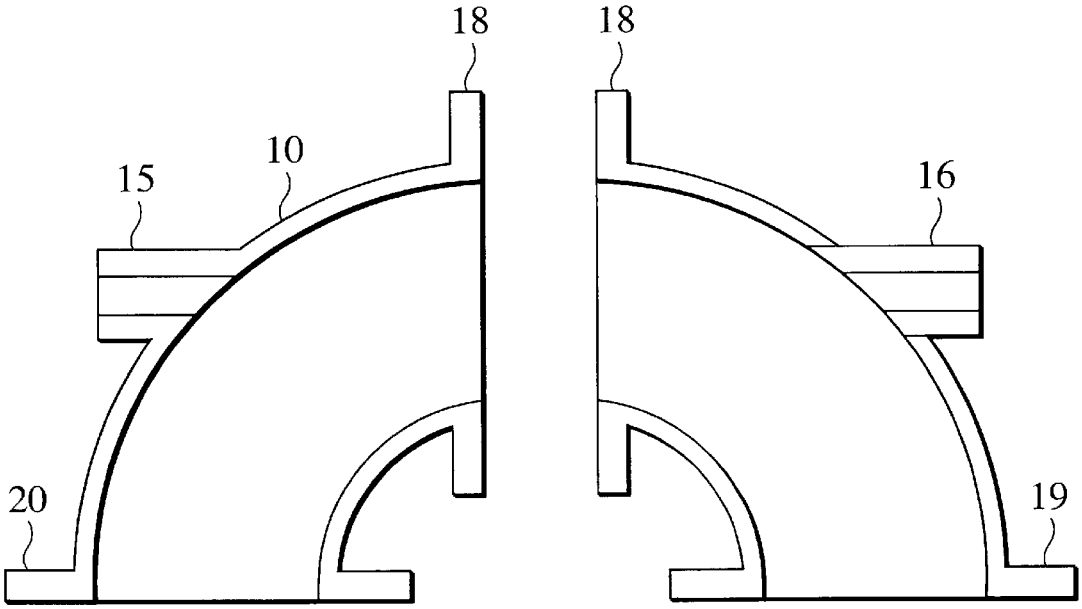
FIG. 4 is an exploded longitudinal sectional view of an impeller casing of the propelling machine of FIG. 3.
Figure 5:
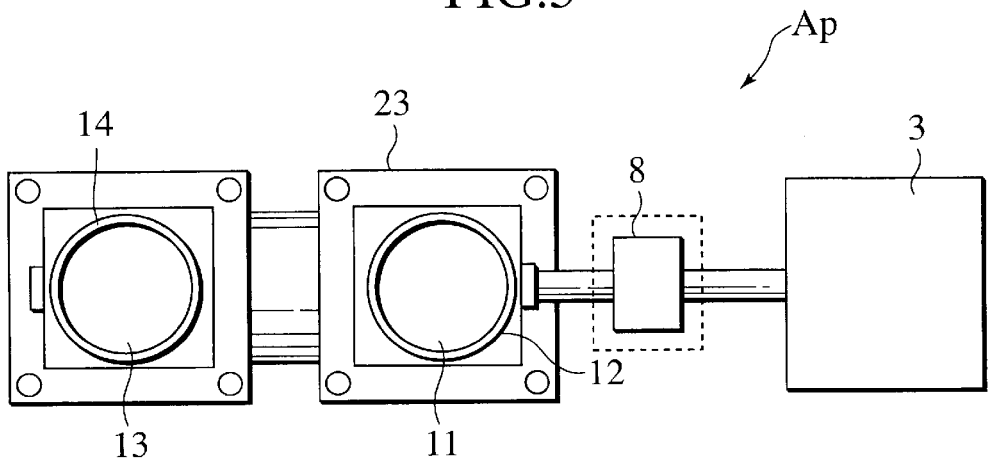
FIG. 5 is a bottom view of the propulsion system of FIG. 3.

FIG. 1 shows a yacht Y equipped with an auxiliary propulsion system Ap according to a first embodiment of the invention, FIG. 2 and FIG. 5 show the auxiliary propulsion system Ap, and FIG. 3 and FIG. 4 show a propelling machine 2 of the auxiliary propulsion system Ap.

The yacht Y is built with a hull 1 equipped with a single mast 1*m* and a set of sails 5 as a principal propulsion system. The hull 1 is equipped, at a bottom 1*b* thereof, with a keel 6 disposed aft (on a bow 1*c* side) of the mast 1*m*, and a helm 4 projecting beneath a stern 1*a*, and has the auxiliary propulsion system Ap incorporated therein between the mast 1*m* and the helm 4 and fixed on an upside of the bottom 1*b*

The auxiliary propulsion system Ap is made up by a water jet propelling machine 2, an internal combustion engine 3 for driving the propelling machine 2, and a forward-reverse rotation shifter 8 installed between the internal combustion engine 3 and the propelling machine 2.

The propelling machine 2 is configured with a drive shaft 9 coupled for connection to the forward-reverse rotation shifter 8, a multi spiral-blade impeller 17 keyed to the drive shaft 9, a impeller casing 10 as a water flow path circumscribed to the impeller 17 with a minute clearance, and a front casing 12 and a rear casing 14 connected to front and rear ends of the impeller casing 10, respectively, and arranged to open through the bottom 1*b*.

In the auxiliary propulsion system Ap, the internal combustion engine 3 drives the propelling machine 2, whereby water is drawn by suction from a fore (or aft) water region and discharged as jets of pressurized water into an aft (or fore) water region, giving a propelling force for the yacht Y to travel or run forward (or backward). The course of yacht Y can be changed by the helm 4.

The yacht Y is propelled to travel with the propelling machine 2 driven by the internal combustion engine 3, in entry to or departure from a port or when in a calm, or with the set of sails 5 receiving winds, in a race or offshore travel, and steered by the helm 4. This propulsion system Ap is applicable also to a carrier or houseboat for travel on a shallow.

The forward-reverse rotation shifter 8 is connected between an output shaft 7 of the internal combustion engine 3 and the drive shaft 9 of the propelling machine 2.

As shown in FIG. 3, the propelling machine 2 is configured curved-tubular as a combination of the impeller casing 10, which is arranged horizontal above the bottom 1*b* at the stern 1*a*, and formed cylindrical at an intermediate part and curved at both ends, to be shaped arcuate, the front casing 12, which is connected to one end of the impeller casing 10 and has a suction inlet 11 opening to the water at the bottom 1*b* on the fore side, and the rear casing 14, which is connected to the other end of the impeller casing 10 and has a delivery outlet 13 opening to the water at the bottom 1*b* on the aft side.

The impeller casing 10 has curved peripheral walls, where bearings 15 and 16 are disposed, which bearings 15 and 16 of the impeller casing 10 serve for horizontally supporting the drive shaft 9 with the impeller 17 fixed thereon.

The impeller 17 thus disposed in the impeller casing 10 is forced to rotate forward or reverse, by the internal combustion engine 3 of which output is shifted at the forward-reverse rotation shifter 8. The impeller 17 is evenly supported in the intermediate part of the impeller casing 10, with reduced vibrations.

The impeller casing 10 is connected, as shown in FIG. 3, at the intermediate part by flanges 18, 18, where it is separable fore and aft, as shown in FIG. 4. The impeller casing 10 has at both ends thereof flanges 19 and 20 formed thereon to be fastened to flanges 19 and 20 formed at upper ends of the front casing 12 and the rear casing 14, respectively, whereby assembly as well as disassembly of the propelling machine 2 is facilitated.

As shown in FIG. 3, the suction inlet 11 of the front casing 12 is provided with a plurality of rectification vanes 21 arrayed therein and inclined with their lower ends positioned fore, for guiding, in travel, streams of water to inflow the suction inlet 11 of the front casing 12, with increased push-in pressures. The rectification vanes 21 are arranged parallel, with a screening function to prevent foreign matters from entering the front casing 12.

The delivery outlet 13 of the rear casing 14 also has a plurality of rectification vanes 22 arrayed therein and inclined with their lower ends positioned aft, for rectifying swirling streams of water pressurized by he impeller 17 into straight streams to be discharged as rearward jets in a water region on the aft side at the stern 1*b*, giving a propelling force for the boat 1 to travel forward.

As shown in FIG. 3 and FIG. 5, the front casing 12 as well as the rear casing 14 has at the lower end a rectangular fixing flange 23 fitted thereon, which fixing flange 23 is detachably attached to be fixed to the bottom 1*b*. The propelling machine 2 is thus united in a compact structure, wherein noises are reduced and whereby the fixing as well as removal of the propelling machine 2 to and from the hull 1 is facilitated.

Figure 6:
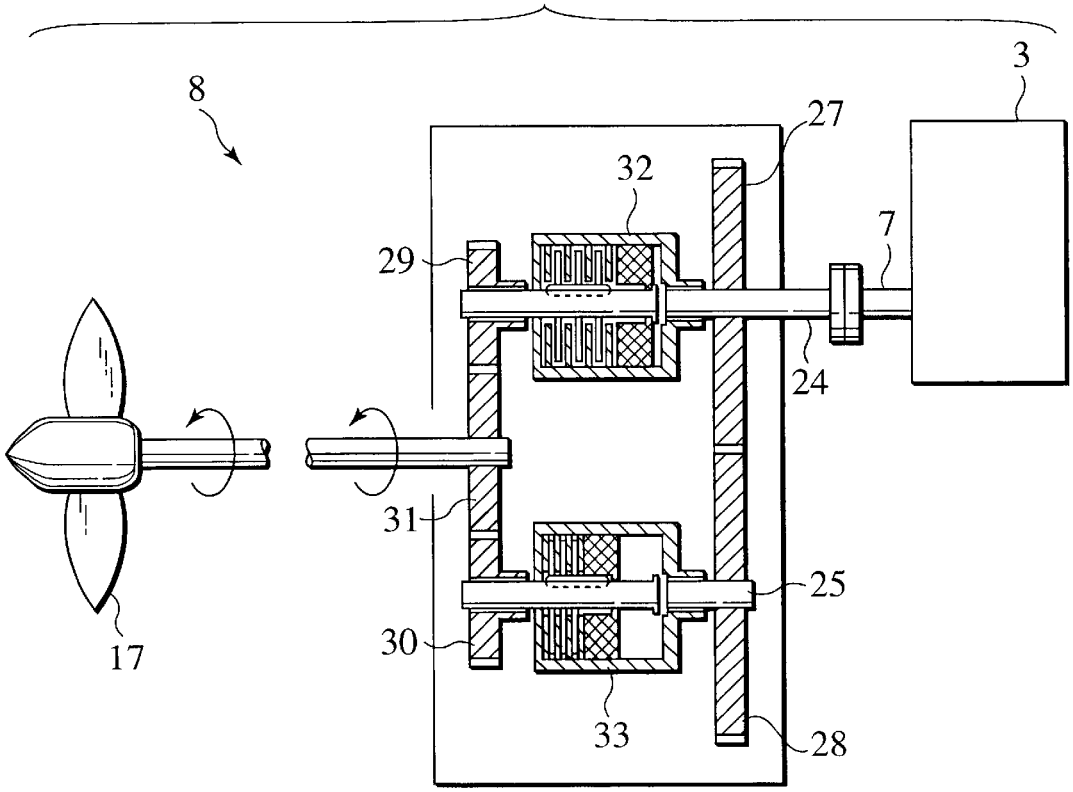
FIG. 6 is an illustration of a forward-reverse rotation shifter of the propulsion system of FIG. 3.

FIG. 6 shows the forward-reverse rotation shifter 8 installed between the internal combustion engine 3 and the impeller 17. The gear case rotatably supports an input shaft 24 and an idle shaft 25, which are coupled or operatively connected with the output shaft 7 of the internal combustion engine 3. A first gear 27 fixed on the input shaft 24 and a second gear 26 fixed on the idle shaft 25 mesh with each other, rotating in opposite directions.

The input shaft 24 and the idle 25 have at their distal ends a first transmission gear 29 and a second transmission gear 30 fixed thereon, respectively, which first and second transmission gears 29 and 30 mesh with a drive gear 31 fixed on the drive shaft 9, which is inserted into the gear case. A forward-propulsion oriented multi-disc clutch 32 is fitted to the input shaft 24, whereto the first transmission gear 29 loose-splined on the shaft is hydraulically operatively connected to effect forward rotation of the impeller 17 on the drive shaft 9.

A backward-propulsion oriented multi-disc clutch 33 is fitted to the idle shaft 24 as well, whereto the second transmission gear 30 loose-splined on the shaft is hydraulically operatively connected to effect reverse rotation of the impeller 17 on the drive shaft 9.

As shown in FIG. 3, the inside diameter of the impeller casing 10 and those of the front casing 12 and the rear casing 14 are substantially identical in size, so that discharge power of pressurized water jets is substantially equalized between forward and reverse rotations of the impeller 17, allowing for the hull 1, even in backward travel, to obtain the propelling force of forward travel, effecting a fast switching between forward travel and backward travel of the boat.

As an output of the internal combustion engine 3 has a rotational direction switched reverse by the forward-reverse rotation shifter 8, water incoming from the delivery outlet 13 of the rear casing 9 at the bottom 1*b* is guided by the rectification vanes 22, to be transmitted to an aft end of the impeller 18. Water transmitted to the rear side of the impeller 18 is pressurized by the impeller 18 in reverse rotation, and resultant swirling streams of water are rectified by the rectification vanes 21 disposed at the suction inlet 11 of the front casing 12, to be discharged fore as water jets, of which a propelling force propels the hull 1 to travel backward. In the backward travel, a turning can also be possible by the helm 4.

Figure 7:
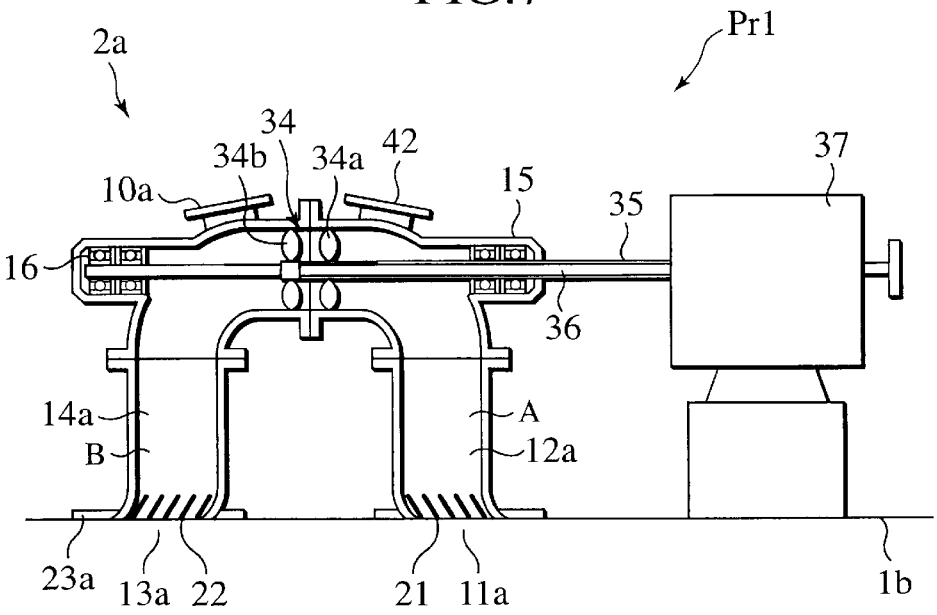
FIG. 7 is a longitudinal sectional view of a propulsion system for boats according to another embodiment of the invention.

FIG. 7 shows a propulsion system Pr1 for boats according to another embodiment of the invention. This propulsion system Pr1 has a propelling machine 2*a* provided with a counter-rotating double impeller 34 in an impeller casing 10*a*, which is configured as a combination of a front impeller 34*a* and a rear impeller 34*b* fixed on a hollow drive shaft 35 and a drive shaft 36, respectively, with the drive shaft 36 coaxially inserted in the hollow drive shaft 35. The hollow drive shaft 35, on which the front impeller 34*a* is fixed, and the drive shaft 36, on which the rear impeller 34*b* is fixed, are operatively connected to a forward-reverse rotation effecter 37.

In the embodiment Pr1 shown in FIG. 7, a front casing 12*a* of the propelling machine 2*a* has a suction flow path A inclined fore, and a rear casing 14*a* has a delivery flow path B inclined aft, so that a lower end of the front casing 12*a* is substantially parallel to rectification vanes 21 arranged in a suction inlet 11*a*, providing streams of water during travel with increased tendencies to enter the front casing 12*a* from the suction inlet 11*a*.

A delivery outlet 13*a* at a lower end of the rear casing 14*a* is substantially parallel to rectification vanes 22, so that streams of water guided by the rectification vanes 22 of the rear casing 14*a* are discharged aft as jets into the water under the boat bottom 1*b*. Designated by reference character 23*a* is a fixing flange fastened to the lower end of the front casing 12*a*, as well as of the rear casing 14*a*.

Figure 8:
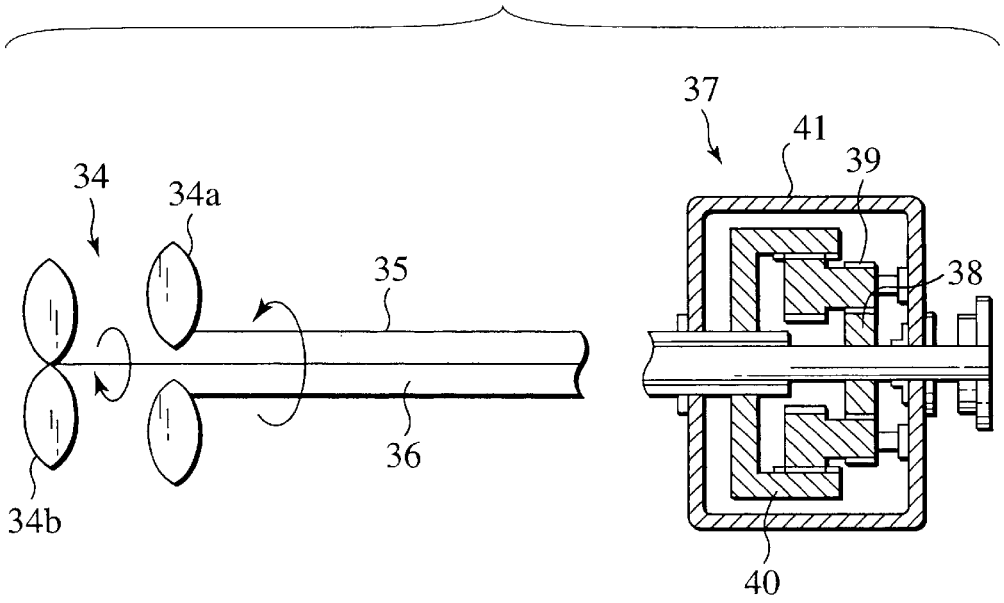
FIG. 8 is an illustration of a counter-rotating double impeller of the propulsion system of FIG. 7.

As shown in FIG. 8, the forward-reverse rotation effecter 37 is configured to be accommodated in a gear case 41, with a sun gear 38 fixed on a proximal end of a drive shaft 36, a plurality of planet gears 39 arranged about the sun gear 38, meshing therewith, and an internal toothed gear 40 as a ring gear fixed on a proximal end of a hollow drive shaft 35 and engaged for meshing with outer peripheries of the planet gears 39, so that, as the sun gear 38 rotates, the internal gear 40 is reverse-rotated via the planet gears 39, thereby rotating in opposite directions the hollow drive shaft 35, on which the front impeller 34*a* is fixed, and the drive shaft 36, on which the rear impeller 34*b* is fixed.

In the propelling machine 2*a* provided with the reverse-rotating double impeller 34, inflowing water from the suction inlet 11*a* of the front casing 12*a* is pressurized and converted into swirling streams by the front impeller 34*a*, which are guided onto blade surfaces of the rear impeller 34*b*, which converts them into straight streams, exerting thereon increased push-in pressures, effecting additional pressurization. Rotational power is energy-converted into pressures at the counter-rotating double-impeller 34, and high-pressure jets are discharged into the water from the delivery outlet 13*a* of the rear casing 14*a*, whereby the boat is propelled forward, while the course of boat is turnable by a helm.

The propelling machine 2*a* provided with the reverse-rotating double impeller 34 has an increased propelling force, and is adapted, as the propelling machine 2*a* has no projections under the boat bottom 1*b*, for such applications as to a houseboat with a shallow draft and a shallow travelling boat.

It is noted that the propelling machine 2 shown in FIG. 3 may as well be modified to have a counter-rotating double impeller 34 in place of the single stage impeller 17.

The forward-reverse rotation effecter 37 coupled for connecttion to the propelling machine 2*a* as shown in FIG. 7 is connected to the forward-reverse rotation shifter 8 direct-coupled with the internal combiustion engine 3 as shown in FIG. 6, so that rotation of the output shaft 7 of the internal combustion engine 3 is transmitted via the forward-reverse rotation shifter 8, where the rotation is shifted from forward to reverse, thereby switching, into mutually opposite rotatoinal directoins, the front impeller 34*a* and the rear impeller 34*b* of the counter-rotating double impeller 34 that the forward-reverse rotation effecter 37 operates.

As an output of the internal combustion engine 3 is transmitted via the forward-reverse rotation shifter 8 set to shift the rotation into a reverse direction for reverse-rotating the counter-rotating double impeller 34, the rear casing 14*a* draws water by suction from the delivery outlet 13*a* submerged under the boat bottom 1*b* at the stern 1*a*, and water transferred to the rear side of the rear impeller 34*b* is pressurized and converted into swirling streams by the rear impeller 34*b*, which are rectified by the front impeller 34*a*, to be discharged fore at the suction inlet 11*a* of the front casing 12, as jets of pressurized water into the water, whereby the boat is propelled backward.

If foreign matters are caught on the rectification vanes 21 at the suction inlet 11*a* of the front casing 12*a*, blocking the suction inlet 11*a*, then the counter-rotating double-impeller 34 can be reverse-rotated for discharging pressurized water streams from inside the front casing 12*a* to wash off the foreign matters blocking the suction inlet 11*a*.

In the embodiment Pr1 shown in FIG. 7, a impeller casing 10*a* is configured with an inspection hole 42 to enable an inspection into the impeller casing 10*a*, where the counter-rotating double impeller 34 is disposed.

Figure 9:
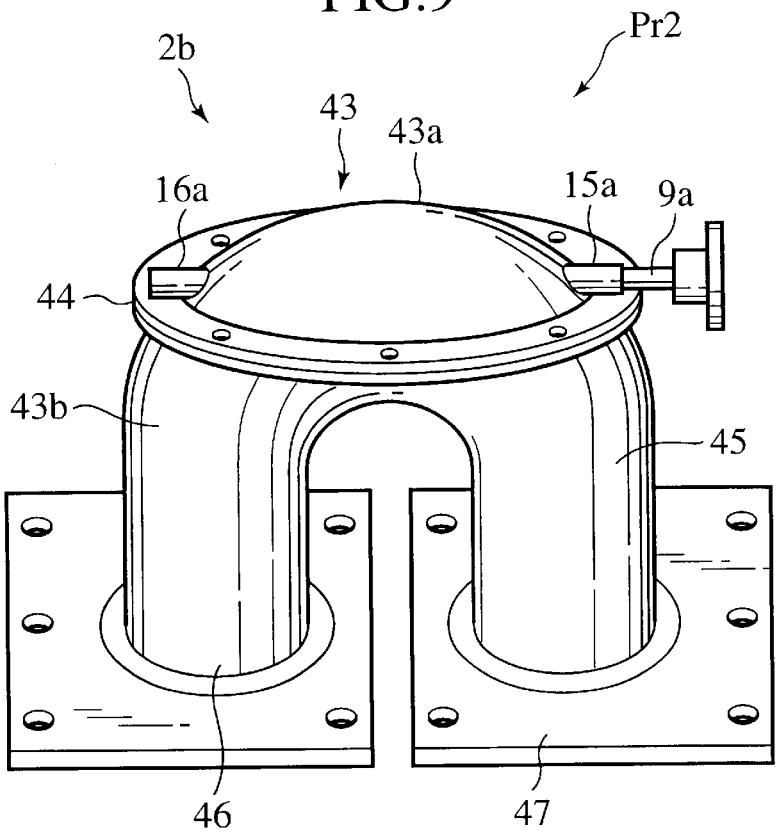
FIG. 9 is a perspective view of a propulsion system for boats according to another embodiment of the invention.

FIG. 9 shows a propulsion system Pr2 for boats according to another embodiment of the invention. This propulsion system Pr2 includes a propelling machine 2*b* configured with: an impeller casing 43, which is divided into an upper casing 43*a* as an upper half thereof and a lower casing 43*b* as a lower half thereof, which are joined together by flanges 44, 44; and a drive shaft 9*a* supported by bearings 15*a* and 16*a* arranged on a peripheral wall of the upper casing 43*a*.

The lower casing 43*b* is integrally formed with a front casing 45 and a rear casing 46 disposed fore and aft, the front casing 45 and the rear casing 46 being each connected at lower end thereof to a fixing flange 47. The upper casing 43*a* is removable for an overhal or replacement of an impeller 17 or counter-rotating double impeller 34 to be facilitated, as well as for removal of string-like matters binding thereon.

It is noted that the inspection hole 42 of the impeller casing 10*a* of FIG. 7 may preferably be provided to either part of the impeller casing 10 divided fore and aft as shown in FIG. 3, or to the upper casing 43*a* of the impeller casing 43 divided up and down as shown in FIG. 9.

Figure 10:
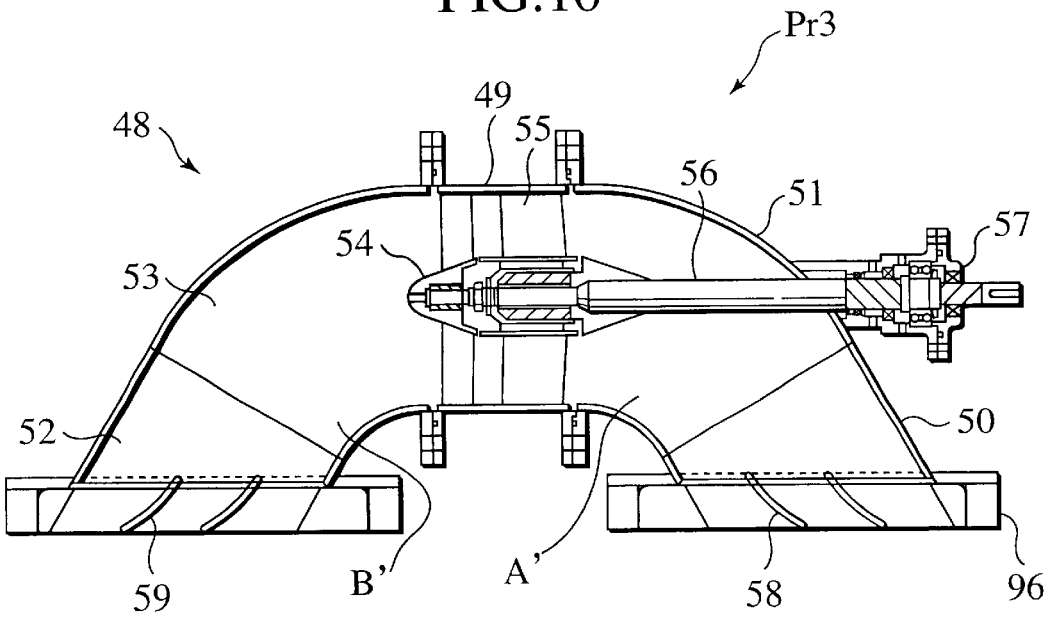
FIG. 10 is a longitudinal sectional view of a propulsion system for boats according to another embodiment of the invention.

FIG. 10 shows a propulsion system Pr3 for boats according to another embodiment of the invention, in which a propelling machine 48 has a front casing 51 defining a suction flow path A' inclined fore, and a rear casing 53 defining a delivery flow path B' inclined aft.

The front casing 51 has a suction inlet 50, where a plurality of rectification vanes 58 . . . are arranged with their lower ends moderately slanting fore in a curvilinerar form for guiding streams of running water inflowing the suction inlet 50 of the front casing 51, to thereby increase push-in pressures to the impeller casing 49, having enhanced water pressurizing forces along connected blade surfaces of axial flow blades 55.

The rear casing 53 has a delivery outlet 52, where also a plurality of rectification vanes 59 . . . are arranged with their lower ends moderately slanting aft in a curvilinerar form for converting swirling streams of water pressurized by the axial flow blades 55 into straight streams, discharging as jets into the water under the stern 1*b*, with a propelling force to propel the boat forward.

The front casing 51 as well as the rear casing 53 is connected at the lower end to a fixing flange 96, so that the propelling machine 48 is detachably attached as a unit to the boat bottom 1*b*.

The impeller 17 or 34 inscribed to the impeller casing 10 as shown in FIG. 3 may also preferably be cofigured with axial flow blades for having water pressurizing forces substantially equalized between forward and reverse rotations, with a sufficient increase in water pressurizing force when the axial flow blades are reverse rotated. In particular, in arrangement of the propelling machine 2*a* shown in FIG. 7, as the counter-rotating double impeller 34 inscribed to the impeller casing 10*a* is configured with axial flow blades, swirling streams of water pressurized by the front impeller 34*a* can be guided onto blade surfaces of the rear impeller 34*b* with increased push-in pressures, so that the rear impeller 34*b* can additionally pressurize drawn water, while effecting conversion into straight streams.

Figures 11A, 11B, 11C, 11D:
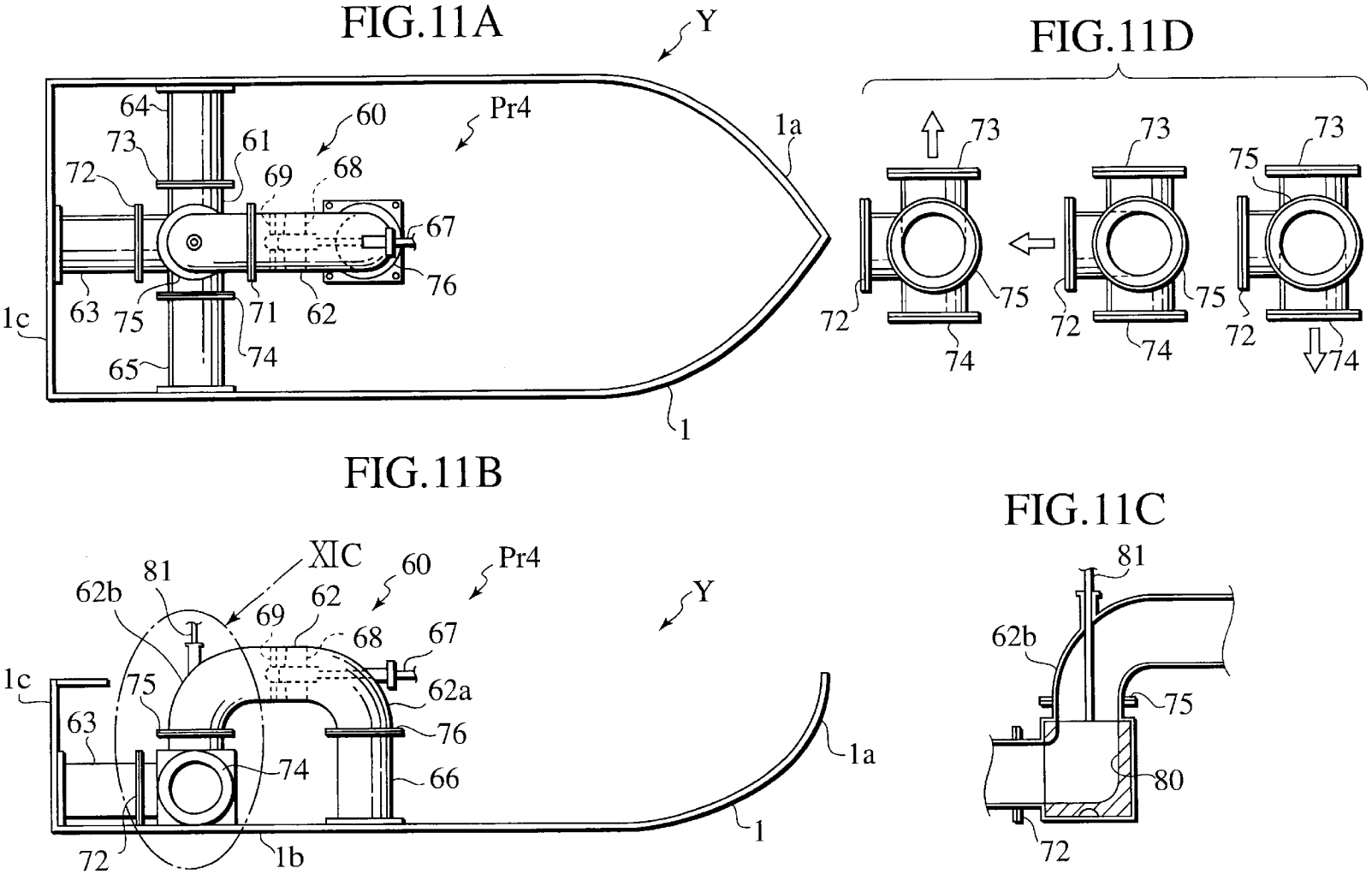

FIG. 11A to FIG. 11D show a propulsion system Pr4 for a yacht Y according to another embodiment of the invention, in which FIG. 11A is a plan of the propulsion system Pr4, FIG. 11B is a side view of the propulsion system Pr4, FIG. 11C is a section of arrow-indicated portion XIC of FIG. 11B, and FIG. 11D illustrates a flow path selection mechanism of the propulsion system Pr4.

The propulsion system Pr4 is configured with a U-shaped impeller casing 62 analogous in arrangement to the impelling machine 2, a set of a front casing 66 and a 3-way casing 61 connected vy flanges 76 and 75 to front and rear ends of the casing 62, respectively, and a set of a rear casing 63, a left casing 64, and a right casing 65 connected by flanges 72, 73, and 74 to the 3-way casing 61 and substantially horizontally opening to the water at a stern 1*c*, a left side, and a right side of the yacht, respectively. The rear casing 63, left casing 64, and right casing 65 are fixed to a hull 1 at delivery outlets thereof, where respective pluralities of horizontal rectification plates are arranged. The front casing is aanalogous in arrangement at the delivery end to the propelling machine 2. For driving a single stage impeller 68 or a counter-rotating double impeller 68+79, there is provided a drive shaft 67, which also has analogous arrangement in connection with an internal combustion engine to the case of auxiliary propulsion system Ap. It is noted that, as illustrated in FIG. 11A, the impeller casing 62 may preferably be joined at an intermediate part thereof by a flange 71 for convenient inspection or maintenance.

As shwon in FIG. 11C, the 3-way casing 61 has a flow path selection valve 80 incorporated therein for selecting an arbitrary one of leftward, rearward, and rightward flow paths to thereby propel the yacht Y rightward, forward, or leftward.

The arrangement of the embodiment Pr4 may preferably be applied to any embodiment else.

Figure 12:
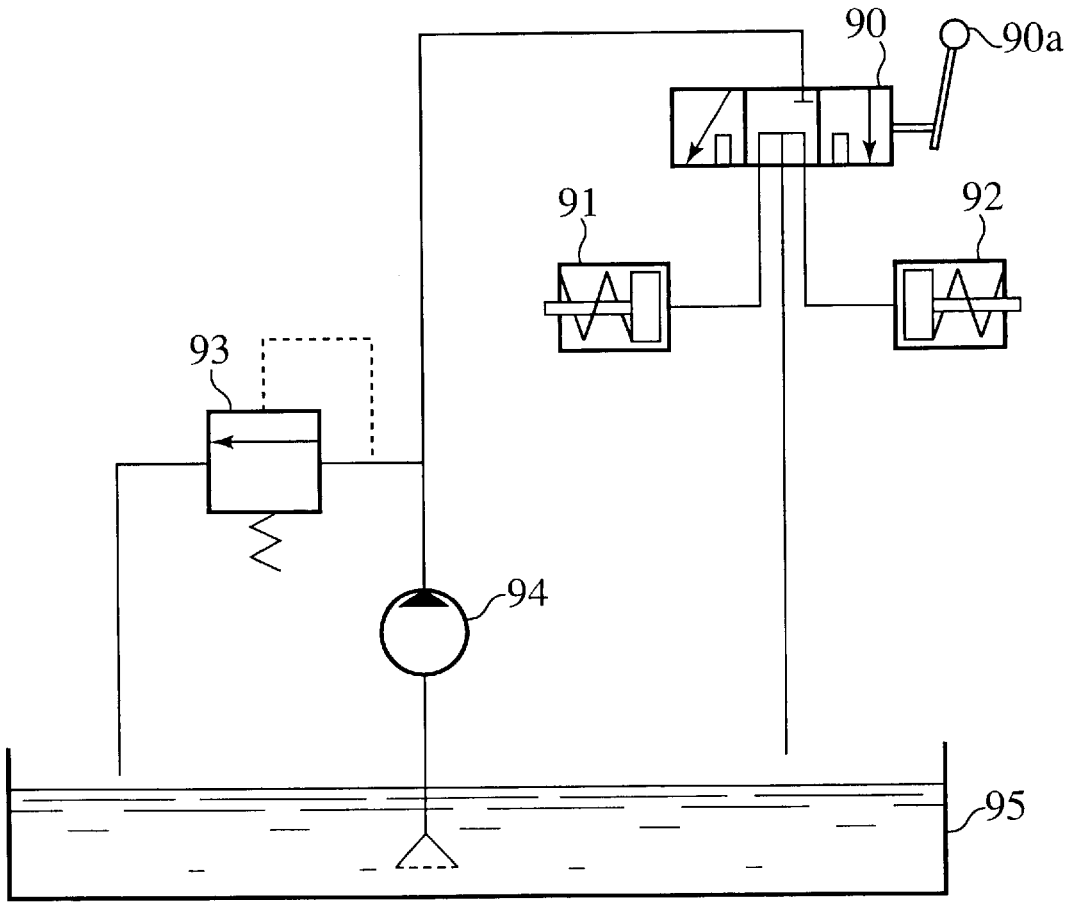
FIG. 12 is a hydraulic circuit for forward-reverse rotation shifter.

FIG. 12 show a hydraulic circuit for forward-reverse shifter or clutch applicable to each embodiment described.

In this hydraulic circuit, as a switching valve 90 is operated by a switching lever 90*a*, the hydraulic pressure is switched between a forward propulsion clutch 91 and a backward propulsion clutch 92, which are connected to an associated operational part of a forward-backward propulsion switching mechanism. In the figure, designated by reference character 93 is a pressure control valve, 94 is a hydraulic pump, and 95 is an oil tank.

As will be seen from the foregoing description, in a propulsion system for boats according to the invention, as an impeller provided in an impeller casing is driven for rotation by an internal combusiton engine, water is guided from a suction inlet at a boat bottom, along rectification vanes, to be drawn by suction into a front casing, while entry of foreign matters such as dust is prevented by the rectification vanes provided plural in the suction inlet of the front casing.

Then, water inflows the inpeller casing, where it is pressurized by the impeller, and swirling streams of pressurized water are converted into straight streams by rectification vanes of a rear casing, so that swirling power is energy converted into pressures, whereby jets of pressurized water are discharged aft into the water from a delivery outlet at the boat bottom, propelling the boat forward.

If the rectification vanes of the front casing are blocked with foreign matters, the impeller can be reverse rotated, so that water drawn by suction from the delivery outlet of the rear casing is discharged as pressurized water jets from the suction inlet of the front casing, washing off the foreign matters blocking the rectification vanes.

The impeller to be prodived in the impeller casing of the propelling machine may prefearbly comprise a counter-rotating double-impeller, with an improved suction performance due to water streams during travel, and an improved delivery performance due to counter rotation of double impellers, with a greater propelling force than by a single impeller.

The impeller to be inscribed to the impeller casing may preferably comprise axial flow blades, having substantially equalized water pressurizing forces, whether forward rotation or reverse rotation, with a sufficient increase in pressurizing force to water due to reverse rotating axial flow blades.

In particular, the counter-rotating double impeller may preferably comprise axial flow blades, so that swirling streams of water pressurized by a front impeller are guided onto blade surfaces of a rear impeller, with increased push-in pressures, and converted into straight streams, with additional pressurization, achieving an increased collection efficiency by conversion of rotation energy into pressure energy.

To propel the boat backward, the impeller is rotated reverse, so that water drawn by suction from the delivery outlet of the delivery casing is discharged as jets from the front casing, for backward propulsion, with an amount of pressurized swirling water substantially equalized in the reverse rotation to that in a forard rotation of the impeller of axial flow blades, allowing haste switch between forward travel and backward travel. For a large-scale vessel with a plurality of propelling machines disposed at the stern, an impeller at the turning side may be reverse rotated for cooperation with a helm to have a small turning range. For ispection or maintenance of propelling machine, the impeller casing may be removed, allowing a facilitated overhall or internal cleaning of an impeller installed therein.

A small-scale boat may be lifted above the water surface, allowing a repair of the propelling machine or replacement of consumables on the sea.

The rear casing may be branched to have branch flow paths facing boat sides, for cooperation with the rear casing to enable a flow path selection therebetween, allowing tranverse propulsion.

Therefore, according to the invention, there is achieved an arrangement in which the direction of water suction by a propelling machine as well as the discharge direction of pressurized water jets can be switched for a boat to travel forward or backward, with a minimized energy loss for reversing rotatoin of water streams, thus providing an incrased propelling force, with a facilitated maintenance.

In other words, a boat or yacht equipped with an impeller in the past might have suffered in a shallow, from possible damages to the impeller or an inpeller shaft due to a hitting such as to sands. In a propulsion system having a vortical casing equipped inside a boat bottom, with a vertical axis, kinetic energy to be given to water by an impeller is once converted into pressure energy before re-conversion into kinetic energy, with a great loss in the energy conversion, contrary to the invention in which, without such conversion, a front casing of which a suction inlet is open in a fore water region and a rear casing of which a delivery outlet is open in an aft water region are connected to an impeller casing of which an impeller is rotatable both forward and reverse, with an increased propelling force and possible haste switch between forward travel and backward travel of boat.

An impeller inscribed to an impeller casing may preferably be configured as a counter-rotating double impeller, with a front impeller giving an increased push-in pressure and a rear impeller for converting swirling streams ionto straight streams with additional pressurization, allowing for the conversion from energy of rotational streams to pressure energy, with a greater propelling force than a single impeller.

The impeller to be inscribed to the impeller casing may preferably configured with axial flow blades, having equalized amounts of swirling pressurized water in forward rotation and reverse rotation, achieving in backward travel of boat the propelling force of forward travel.

The propelling machine may preferably have flow paths thereof substantially identical in size of inside diameter to achieve substantially equalized discharge forces of pressurized water, whether the impeller is rotated forward or reverse.

The impeller casing may preferably be configured with arcuate front and rear peripheral walls for supporting a drive shaft of the impeller to be rotated with reduced vibrations and a shortened shaft length.

A bearing support of the impeller casing formed cylindrical and a bearing on a side wall of the front casing may preferably support a drive shaft on which axial flow blades are fixed, allowing the shaft length to be short, as well as the propelling machine to be compact.

In the propelling machine, the suction inlet of the front casing as well as the delivery outlet of the rear casing may prefearbly have a plurality of recitification vanes arranged therein for guiding water streams under suction and rectifying pressurized swirling streams to improve propsulsion efficiency, besides possible removal of foreign matters.

The front casing may preferably have a suction flow path inclined fore and the rear casing may preferably have a delivery flow path inclined aft, allowing suction of runing water streams during travel and aft discharge of jets in the water to provide an incerased propelling force.

The font casing as well as the rear casing may preferably be fastened at the lower end to a fixing flange, achieving a compact arrangement without projections at the bottom of boat, allowing for the propelling machine to be attached to or detached from the bottom, as a unit, with ease, so that an inspection or repair thereto can be performed on the sea by lifting the boat.

The impeller casing may preferably be configured separable, allowing for facilitaetd assembly and disassembly of the impeller casing to which the impeller is inscribed, facilitating an overhall of the impeller disposed inside the impeller casing, as well as an internal cleaning of the propelling machine.

An inspection hole may preferably be provided to the impeller casing in a vicinity of the impeller, with a facilitated inspection into the impeller casing, allowing damages such as to the impeller to be prevented in advance.

The rear casing may preferably be branched to provide a branch path facing a boat side, for cooperation with the rear casing to enable a flow path selection therebetween, enabling a transverse propulsion.

INDUSTRIAL APPLICABILITY

According the invention, there is provided a propulsion system for boats with an incorporated impeller, allowing switch between forward and backward travels without turning the impeller, with simplified boat equipment.

What is claimed is:

1. A propulsion system for boats, wherein:

a propelling machine is configured curved- tubular, on a ship bottom, with a front casing having a suction inlet opening fore to water, an impeller casing having an impeller inscribed thereto, and a rear casing having a delivery outlet opening aft to water; and the impeller inscribed to the impeller casing is forward and reverse rotatable;

wherein the impeller casing, and the front casing and the rear casing, connected to front and rear ends of the impeller casing, respectively, have flow paths therein substantially identical in size to an inside diameter; and wherein the impeller casing is separable into an upper half of the impeller casing and a rear half of the impeller casing; and a drive shaft is supported by the upper half of the impeller casing.

2. The propulsion system for boats according to claim 1, wherein the impeller inscribed to the impeller casing is configured as a counter-rotating double impeller comprising a front impeller and a rear impeller.

3. The propulsion system for boats according to claim 1, wherein the impeller inscribed to the impeller casing comprises axial flow blades.

4. The propulsion system for boats according to claim 1, wherein:

the impeller casing is configured arcuate; and a drive shaft with the impeller fixed thereon is supported by bearings disposed on front and rear peripheral walls of the impeller casing.

5. The propulsion system for boats according to claim 1, wherein:

the impeller casing is configured cylindrical; and a drive shaft with axial flow blades fixed thereon is supported by a bearing support connected to a rear end of the impeller casing and a bearing on a side wall of the front casing.

6. The propulsion system for boats according to claim 1, wherein the suction inlet of the front casing and the delivery outlet of the rear casing have plural rectification vanes respectively, for rectifying water streams to inflow the propelling machine and preventing foreign matters from inflowing.

7. The propulsion system for boats according to claim 1, wherein:

the front casing has a suction flow path inclined fore; and the rear casing has a delivery flow path inclined aft.

8. The propulsion system for boats according to claim 1, wherein:

the front casing and the rear casing of the propelling machine are connected at lower ends thereof to fixing flanges; and the fixing flanges are detachably attached to openings of the bottom of boat.

9. The propulsion system for boats according to claim 1, wherein the impeller casing is separable fore and aft.

10. The propulsion system for boats according to claim 1, wherein an inspection hole is provided to the impeller casing in a vicinity of the impeller.

11. The propulsion system for boats according to claim 1, wherein a boat-side fronting branch path is branched from the rear casing, and cooperative with the rear casing to effect a flow path selection therebetween.

* * * * *